US005503119A

United States Patent [19]

Glover

[11] Patent Number: 5,503,119

[45] Date of Patent: Apr. 2, 1996

[54] CRANKCASE SCAVENGED TWO-STROKE ENGINES

[75] Inventor: Stephen B. Glover, Worthing, England

[73] Assignee: Ricardo Consulting Engineers Limited, West Sussex, England

[21] Appl. No.: 490,585

[22] Filed: Jun. 15, 1995

[30] Foreign Application Priority Data

Jun. 17, 1994 [GB] United Kingdom ..... 9412181

[51] Int. Cl.[6] ..... F02B 33/04

[52] U.S. Cl. ..... 123/73 B; 123/73 PP

[58] Field of Search ..... 123/73 B, 73 AA, 123/73 PP, 65 A

[56] References Cited

U.S. PATENT DOCUMENTS

| | | | |
|---|---|---|---|
| 1,026,425 | 5/1912 | Barthel . | |
| 1,092,042 | 3/1914 | Hagar . | |
| 2,893,362 | 7/1959 | Dalrymple . | |
| 3,190,271 | 6/1965 | Gudmundsen | 123/73 B |
| 4,625,688 | 12/1986 | Takayasu . | |
| 5,159,903 | 11/1992 | Takahashi | 123/73 B |
| 5,379,732 | 1/1995 | Mavinahally et al. | 123/73 PP |
| 5,404,843 | 4/1995 | Kato | 123/73 B |

FOREIGN PATENT DOCUMENTS

| | | |
|---|---|---|
| 343867 | 11/1921 | Germany . |
| 115703 | 1/1946 | Sweden . |
| 2022699 | 12/1979 | United Kingdom . |

*Primary Examiner*—Marguerite Macy
*Attorney, Agent, or Firm*—McAulay Fisher Nissen Goldberg & Kiel

[57] ABSTRACT

A two-stroke engine of crankcase scavenged type includes a piston reciprocably mounted in a cylinder, an exhaust port, an inlet port arranged to supply combustion air to the crankcase and a transfer port comprising two or more transfer passages extending between the crankcase and the cylinder. The transfer port is arranged to open before the exhaust port closes whereby, in use, the cylinder is scavenged. Fuel metering means communicates with at least one but not all of the transfer passages and is arranged to supply fuel into the said transfer passage at a rate which is directly determined by the mass flow rate of air through the inlet port. The fuel metering means includes a metering valve connected to actuating means, which is arranged to modulate the valve in response to the mass flow rate of air through the inlet port and fuel supply means arranged to supply pressurised fuel continuously to the metering valve. The transfer passage includes a non-return valve arranged to prevent the flow of fuel from the transfer passage into the crankcase.

13 Claims, 4 Drawing Sheets

CRANKCASE SCAVENGED TWO-STROKE ENGINES

FIELD OF THE INVENTION

The present invention relates to crankcase scavenged two-stroke engines and is concerned with fuel metering or supply systems for such engines.

DESCRIPTION OF THE PRIOR ART

The cylinder of a crankcase scavenged two-stroke engine contains an inlet port, an outlet port and a transfer port which are arranged so that the exhaust port opens before and closes after the transfer port. The transfer port is essentially one or more transfer passages linking the cylinder and crankcase that are arranged in such a way so that the piston in the cylinder controls the opening and closing of the downstream end of the transfer passages during the engine cycle. This type of engine has a hermetically sealed crankcase which communicates with the cylinder via the transfer port and the outside via an inlet duct. As the piston performs its cylinder compression stroke air or an air/fuel mixture is drawn into the crankcase from outside the engine through the inlet duct and on the subsequent working stroke this air or air/fuel mixture is compressed by the piston. As the piston continues to move it uncovers the downstream end of the transfer port and the air or air/fuel mixture is forced into the cylinder.

The transfer of air or air/fuel mixture into the cylinder only occurs when a positive pressure differential exists between the crankcase and cylinder. The fresh charge of air or air/fuel mixture entering the cylinder causes the displacement of residual gas from the cylinder via the exhaust port. During this cylinder scavenging process a portion of the air or air/fuel mixture that has entered the cylinder flows out of the cylinder via the exhaust port. The charge lost in this way is usually termed the scavenge losses. This loss of charge can still occur during the period in the engine cycle between transfer port closure and exhaust port closure. This period is known as the trapping period and as such the associated losses are usually termed the trapping losses.

Most two-stroke engines, and currently all two-stroke engines which are relatively cheap, as are fitted on small motorcycles, scooters and the like, are provided with a carburettor which is arranged to dispense fuel into the inlet duct in an amount which is related to the air flow rate through that duct. This means that all the air/fuel mixture which enters the crankcase and subsequently the cylinder is inherently a substantially homogeneous mixture of air and fuel. This means in turn that the proportion of the scavenging air which flows out of the exhaust port also contains fuel. This results in the unburnt hydrocarbon emissions of such engines being relatively high. This is becoming increasingly unacceptable and can not be remedied by the simple provision of an oxidising catalyst in the exhaust duct because the volumes of fuel which need to be oxidised are simply too great to be oxidised by a catalyst of a practicable size and durability.

The problems referred to above may be solved by ensuring that the inlet charge entering the cylinder is of a stratified type, that is to say that the charge entering the cylinder is non-homogeneous in such a manner that substantially only pure air and a minimum quantity of fuel is permitted to pass directly from the cylinder into the exhaust port during the scavenging and trapping processes.

This may be achieved by providing the engine with direct fuel injection, that is to say a fuel injector which communicates directly with the cylinder and is controlled by an electronic control system which is arranged to ensure that the correct amount of fuel is injected into the cylinder after the exhaust port has closed. Whilst effective, this solution to the problem is expensive due to the need to provide a speed and load-responsive electronic control system and a fuel injector.

An alternative solution to the problem is to provide a crankcase scavenged engine with so-called transfer port stratified charging. The transfer port in such engines typically comprises a number of passages in parallel. Stratified charging of the cylinder can be achieved by using one or more of these transfer passages to introduce a fuel/air mixture into the cylinder, the remaining transfer passages delivering essentially pure air only. Communicating with the selected transfer passage or passages is a fuel injector which is arranged to inject into the selected transfer passage or passages an amount of fuel which corresponds to the requirements of the engine only when the selected transfer passage or passages communicate with the cylinder. After the downstream end of the selected transfer passage or passages is uncovered by the piston, air flows through them from the crankcase to the cylinder when a positive pressure differential exists and carries with it the fuel injected by the fuel injector and thus achieves stratified charging, whereby little or no fuel is displaced into the exhaust port. However, the necessity of providing a fuel injector and the associated electronic controls can make this type of fuelling arrangement unacceptable for low cost applications, such as motor scooters.

It is therefore an object of the present invention to provide a two-stroke engine of crankcase scavenged type with a fuel metering system which has reduced unburnt hydrocarbon emissions, that is to say reduced at least to a level at which is practicable to use an oxidising catalyst in the exhaust system to reduce the hydrocarbon emissions even further, and in which the fuel metering system is sufficiently simple that it may be manufactured sufficiently cheaply that it is acceptable for use on low cost engines for use on motor scooters, small motor bikes and the like.

SUMMARY OF THE INVENTION

According to the present invention a two-stroke engine of crankcase scavenged type includes a piston reciprocably mounted in a cylinder, an exhaust port, an inlet port arranged to supply combustion air to the crankcase, a transfer port comprising two or more transfer passages extending between the crankcase and the cylinder, the transfer port being arranged to open before the exhaust port closes whereby, in use, the cylinder is scavenged, and fuel metering means which communicates with at least one but not all of the transfer passages and is arranged to supply fuel into the said transfer passage at a rate which is a function of the mass flow rate of air through the inlet port and is characterised in that the fuel metering means includes a metering valve connected to actuating means, which is arranged to modulate the valve in response to the mass flow rate of air through the inlet port, and fuel supply means arranged to supply pressurised fuel continuously to the metering valve and that the said transfer passage includes non-return means arranged to prevent the flow of fuel from the said transfer passage into the crankcase.

Thus in the engine in accordance with the invention the known expensive fuel injector and associated electronic control system arranged to inject fuel into one of the transfer passages only when air is flowing through the transfer passage from the crankcase into the cylinder is replaced by a very much simpler fuel metering system of mechanical type which dispenses fuel into the said transfer passage substantially continuously and at a rate which is directly determined by the mass flow rate of air through the inlet passage. All the fuel is dispensed into the transfer passage and no additional fuel is dispensed directly into the inlet port. This results in a considerable simplification and economy. The fuel is supplied virtually continuously by the fuel metering means into the said transfer passage and thus at those times when air is not flowing through the passage(s) in question into the cylinder there is an inherent tendency for the fuel to flow backwards into the crankcase. In order to prevent this non-return means are arranged to prevent the flow of fuel into the crankcase but of course to permit the flow of air from the crankcase into the said transfer passage.

As described above, it is an inherent feature of two-stroke engines that a portion of the air which flows into the cylinder flows through and out into the exhaust port during the scavenging and trapping processes. Except in those engines where stratified charging is used, which can be achieved e.g. by direct fuel injection, the inflowing air contains fuel in the form of a homogeneous mixture and thus the air that is lost to the exhaust port during the scavenging and trapping processes contains fuel. However, the transfer port in a crankcase scavenged two-stroke engine normally comprises two or more transfer passages and the air which is lost to the exhaust port during scavenging and trapping is typically contributed by all the transfer passages. However, if the fuel is supplied into only one or more but not all of the transfer passages this can result in a reduction in the amount of fuel which passes directly into the exhaust port because a proportion of the air which passes directly into the exhaust port originated from the other transfer passages and thus contains no fuel. This reduction in the emission of unburnt hydrocarbons can be sufficient to permit an oxidising catalyst of commercially acceptable size and cost to be used in the exhaust system to catalyse the unburnt hydrocarbons.

However, it is preferred that the said transfer passage is constructed and/or positioned that the volume of air flowing through it which is lost to the exhaust port during the scavenging and trapping processes is less than that flowing through the other transfer passages. This results in the unburnt hydrocarbon emissions being reduced still further. This can be achieved by directing the downstream ends of the transfer passages such that substantially no air which flows through the said transfer passage reaches the exhaust port before it is closed. However, in a preferred embodiment this is achieved by positioning the downstream end of the said transfer passage so that it communicates with the cylinder at a position which is closer to the crankcase than the position or positions at which the remainder of the transfer passages communicate with the cylinder. Thus when the piston performs its working stroke the downstream ends of those transfer passages into which no fuel is supplied are uncovered first by the piston and air flows out of them into the cylinder to scavenge it and then into the exhaust port. The said transfer passage is opened subsequently whereby the flow through it of air and fuel is delayed with respect to the flow of pure air through the other transfer passages.

The said transfer passage may be provided with means known per se for varying the height of its downstream end or the time at which it is uncovered by the piston. Such means may be moved in response to signals produced by the engine control system so as to optimise the delay in flow through the said transfer passage at all engine operating conditions.

Alternatively or additionally a throttling device may be provided in the said transfer passage. This again acts to delay the flow of air and fuel through it with respect to the flow of pure air through the other transfer passages. The throttling device may be fixed and in a particularly simple embodiment is constituted by the transfer passage itself which is constructed with a smaller cross-sectional area than the other transfer passages. Alternatively, the throttling device may be adjustable and arranged to be moved in response to engine speed, the inlet manifold pressure or signals produced by the engine control system so that its effect is optimised at all operating conditions of the engine.

The fuel supply means may take various forms but in one very simple embodiment it comprises a float-controlled reservoir situated above the metering valve, whereby the fuel at the metering valve is pressurised by the hydrostatic head of fuel above it. However, the pressure in the said transfer passage will fluctuate very considerably during each operating cycle of the engine and may at times have a value considerably higher than the hydrostatic pressure exerted by the fuel. This problem may be eliminated by providing a pipe or the like through which the interior of the reservoir above the level of fuel within it communicates directly with the said transfer passage. Changes in pressure on the downstream side of the metering valve therefore occur also in the fuel reservoir whereby the pressure differential across the metering valve remains substantially constant at all times for a given fuel orifice area of the metering valve. The fuel flow orifice area is of course varied as a function of the engine inlet air flow.

The pressure acting on the downstream side of the metering valve depends on the orientation of the outlet of the valve within the said transfer passage and similarly the pressure acting within the reservoir depends on the orientation of the pipe or the like, with which the reservoir communicates with the said transfer passage, within the said transfer passage. In order to ensure that the variations in pressure on the downstream side of the metering valve and within the fuel reservoir are substantially the same it is preferred that the outlet of the metering valve and the transfer passage end of the communication between the reservoir and the said transfer passage are directed in the same direction with respect to the direction of flow within the said transfer passage.

In the event that the fuel supply means operates on the hydrostatic head principle described above, it is preferred that the valve comprises a valve orifice cooperating with a valve needle connected to the actuating means.

In an alternative embodiment, the fuel supply means comprises a fuel pump and the metering valve is of a type known per se whose throughput is substantially independent of the pressure prevailing at its outlet. Such metering valves are known and form part of e.g. the Bosch KA fuel injection system. Thus when a fuel pump is used it is not possible, without using a regulator, to maintain the pressure differential across the valve substantially constant as the pressure in the said transfer duct varies and such pressure variations inherently tend to result in variations in the fuel flow rate through the metering valve. However, such fuel flow variations can be virtually eliminated by using a known valve of the type referred to above.

Alternatively, the fuel supply means may include a pressure regulator between the fuel pump and the metering valve which has a pressure connection communicating with the said transfer port and which is arranged to maintain the fuel pressure differential across the metering valve substantially constant at any given fuel flow opening. In this case the metering valve may be of more conventional type and a substantially constant fuel flow rate is nevertheless ensured regardless of pressure variations in the said transfer passage.

As mentioned above, it is necessary that the said transfer passage includes non-return means at its upstream end to prevent fuel flowing back into the crankcase since if this were to happen the fuel would then enter the cylinder through those transfer passages with which the fuel metering means does not communicate which would result in an increase in the unburnt hydrocarbon emissions of the engine. The non-return means may constitute simply a valve, e.g. a Reed valve, or may comprise a portion of the piston which is so shaped that it obstructs the upstream end of the said transfer passage at substantially all times except that time during which fuel is to be admitted into the cylinder when said transfer passage is not obstructed by the piston, that is to say at that time when air can flow through the said transfer passage from the crankcase into the cylinder. Alternatively, the non-return valve may comprise a valve which is connected to the engine crankshaft to be operated in synchronism therewith such that it is closed at substantially all times except that time during which fuel is to be admitted into the cylinder. The latter two constructions offer the possibility of positioning the downstream ends of all the transfer passages at the same height within the cylinder but timing the non-return valve or shaping the piston so that the said transfer passage is opened later than the other transfer passages. In a further and particularly simple embodiment the non-return means comprises a portion of the said transfer passage which is shaped in the manner of a U bend or the like to act as a liquid trap.

The actuating means for the fuel metering valve may be of a type known per se which includes a movable diaphragm, one side of which is subjected to the pressure within the inlet port. The diaphragm may be situated immediately adjacent the inlet port or it may be remote from it and connected to it by a pipe. The other side of the movable diaphragm is preferably exposed to atmospheric pressure. In order to obtain a more sensitive response, it is possible to magnify the pressure, and thus the pressure differences which occur as the engine load alters, by providing a so-called boost venturi of known type within the inlet port, one side of the movable diaphragm being connected to the interior of the boost venturi by a pipe or the like.

In practice, the pressure in the inlet port will vary very rapidly during each operating cycle of the engine, even if the engine has four or more cylinders, and these variations will be more marked if the engine only has a single cylinder. However, two-stroke engines of the type used on small scooters and the like run at speeds of up to 15,000 rpm and their speed is rarely less than 2,000 rpm. Diaphragm actuators are not capable of responding instantaneously to variations in pressure and thus in practice the diaphragm actuator in the engine of the present invention is responsive to the average value of the pressure in the inlet port which is a function of the rolling average of the mass flow rate of air through the inlet port which is in turn a function of the engine load and speed. The metering valve must thus be initially calibrated to provide fuel at a rate appropriate to the instantaneous value of the engine load and speed and thereafter the metering valve will continuously supply the appropriate volume of fuel into the said transfer passage which is then conveyed periodically into the cylinder at the appropriate time by the air which is compressed in the crankcase by the cylinder and then flows through all the transfer passages. Further features and details of the invention will be apparent from the following description of four specific embodiments of the invention which is given by way of example only with reference to the accompanying diagrammatic drawings.

DESCRIPTION OF THE PREFERRED EMBODIMENTS

Figure 1:
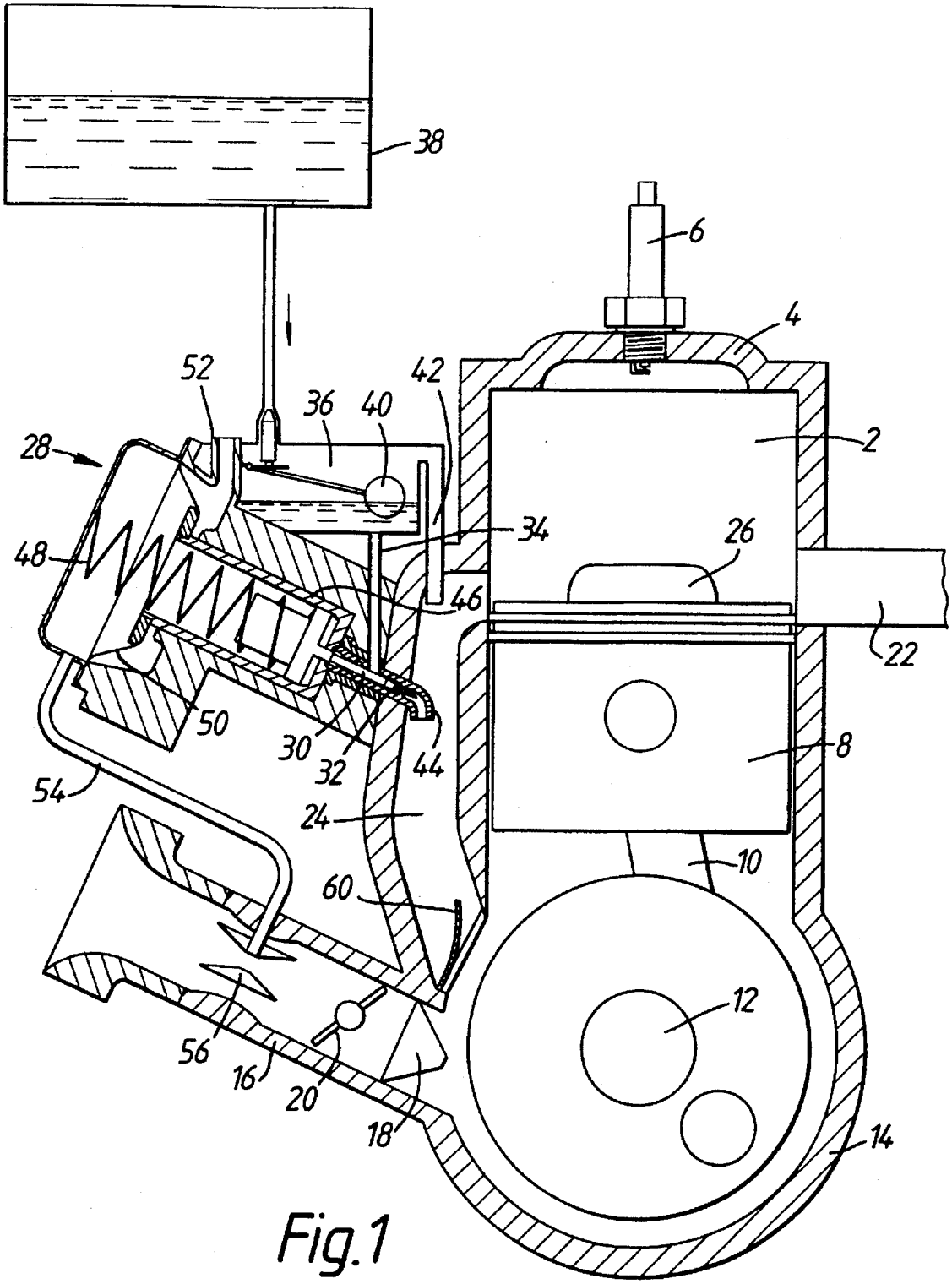
FIG. 1 is a sectional view of a single cylinder of a single or multi-cylinder two-stroke engine and an associated fuel metering system including a float chamber.

Referring firstly to FIG. 1, the engine illustrated may have one or more cylinders but only one cylinder is shown and will be described. The cylinder 2 is closed by a cylinder head 4 through which a spark plug 6 projects in the usual manner. Reciprocably accommodated within the cylinder is a piston 8 which is connected by a connecting rod 10 to a crankshaft 12 arranged within a crankcase 14.

Communicating with the interior of the crankcase 14 is an inlet port 16 at whose downstream end is a Reed valve or the like 18 arranged to permit the flow of air in one direction only, that is to say into the crankcase. Arranged upstream of the Reed valve is a throttle valve 20 of conventional type linked to the accelerator or throttle of the engine.

Communicating with the cylinder 2 is an exhaust port 22 and also, at positions slightly closer to the crankshaft 12, a transfer port which comprises three transfer passages, of which only two, 24 and 26, are visible in the figure. The upper edge, in the Figure, of the passage 24 is slightly closer to the crankcase than that of the other passages 26.

Communicating with the transfer passage 24, but not with the other two transfer passages, is a fuel metering system 28 which includes a valve needle 30 cooperating with a valve orifice 32. Communicating with the upstream side of the valve orifice 32 via a pipe 34 is a float controlled fuel chamber 36 which is supplied with fuel from a fuel tank 38 in response to the position of a float 40 in a known manner so that the volume of fuel in the fuel chamber 36 remains substantially constant. The interior of the fuel chamber 36 communicates with the interior of the transfer passage 24 by means of a pipe 42 whose open end is directed in the upstream direction of the transfer passage. The outlet of the needle valve 30, 32 is within a tubular shroud 44 whose open end is also directed in the upstream direction of the transfer passage 24.

The valve needle 30 is connected to an operating sleeve 46, within which is a restoring spring 48 and which is connected to be moved by a diaphragm 50. One side of the diaphragm is subjected to atmospheric pressure by way of an open pipe 52 whilst the other side of the diaphragm is exposed via a pipe 54 to the pressure prevailing within the interior of a boost venturi 56 which is situated within the inlet port 16 and whose function is to magnify the variations in pressure which occur in the inlet port 16 as the mass flow rate of air through it varies.

In use, when the piston performs its working stroke, that is to say moves towards the crankshaft, it firstly uncovers the exhaust port 22 and a substantial proportion of the exhaust gases are discharged into it. The transfer passages into which no fuel is dispensed are then uncovered by the piston followed shortly thereafter by the transfer passage 24. The air admitted into the crankcase 14 through the inlet port 16 during the previous compression stroke and subsequently compressed during the initial portion of the working stroke of the piston flows through the transfer port into the cylinder, initially through the two transfer passages 26 and subsequently through all three transfer passages. During the period in which air enters the cylinder via the transfer port, the exhaust port is still open and a proportion of the exhaust gas remaining the cylinder is scavenged out into the exhaust port 22, substantially only by the pure air which flowed in through the transfer passages 26.

The fuel on the upstream side of the valve orifice 32 is pressurised by the hydrostatic head of the fuel above it and thus flows virtually continuously into the transfer passage 24 at a rate which is determined by the position of the valve needle 30 which is in turn dependent on the pressure within the boost venturi 56 which is determined by the moving average of the mass flow rate of air through the inlet port 16 and thus the engine load and speed. The fuel dispensed by the fuel metering system flows into the transfer passage 24 and at those times when no air is flowing from the crankcase into the cylinder would tend to run backwards into the crankcase. This is, however, prevented by the provision of a Reed valve 60 at the upstream end of the transfer passage 24. This prevents the flow of fuel back into the crankcase but opens after the downstream end of the transfer passage 24 is uncovered by the piston 8 and a positive pressure differential exists between the crankcase and the cylinder to permit the flow of pressurised air from the crankcase into the cylinder and this flow of air entrains the fuel in the transfer passage 24 and carries it into the cylinder.

The portion of scavenging air which flows through the transfer port is lost to the exhaust port 22, and thus does not take part in the subsequent combustion, is contributed to by the three transfer passages. However, since the fuel is dispensed into only one of the transfer passages, the cylinder is mainly scavenged by substantially pure air only. Thus the proportion of fuel which passes out into the exhaust port 22 is reduced in comparison to a conventional engine in which the cylinder is substantially scavenged by a mixture of fuel and air.

Figure 2:
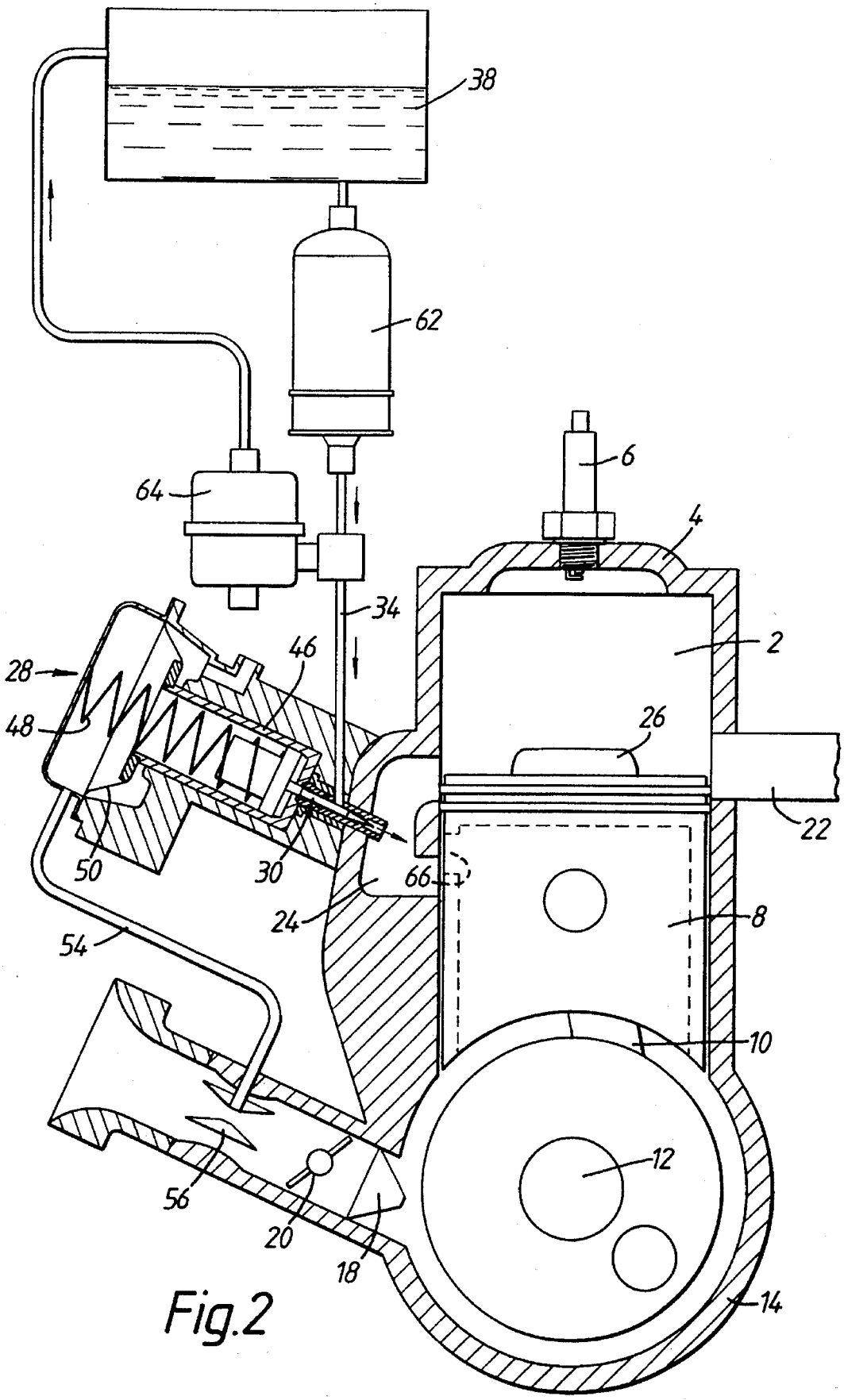
FIG. 2 is a similar view of a second embodiment of a two-stroke engine in which the fuel metering system includes a fuel pump.

The engine illustrated in FIG. 2 is generally similar to that illustrated in FIG. 1 and differs essentially only in two respects. Firstly, the float controlled fuel chamber 36 is replaced by a low pressure fuel pump 62. Connected to the outlet line of the pump, which communicates with the space upstream of the valve orifice 32, is a pressure relief valve 64 which is arranged to return excess fuel pressurised by the pump 62 back to the fuel tank 38 so that the pressure of the fuel supplied to the fuel metering valve remains at a substantially constant value. The pressure with which the fuel is supplied to the fuel metering valve may be rather higher in this embodiment than in the embodiment of FIG. 1 and pressure balancing across the fuel metering valve is not provided in a manner analogous to that achieved by the pipe 42 in the embodiment of FIG. 1 in order to compensate for variations in pressure in the transfer passage 24. Accordingly, the fuel metering valve is of a somewhat different type, which is provided with a spring-loaded ball (not shown) downstream of the valve needle and whose throughput is therefore substantially insensitive to variations of pressure on its downstream side. In alternative constructions, which are not illustrated, the fuel pressure is very high or a pressure regulator with a pressure connection to the transfer passage 24 is provided, whereby in both cases the rate of fuel flow is substantially insensitive to pressure changes in the transfer passage.

Secondly, the Reed valve 60 is omitted and its function is performed by the piston 8, which is hollow, as is conventional. Formed in the piston skirt is an aperture 66 which at some predetermined point in the cycle allows communication of the crankcase and the cylinder via transfer passage 24. The timing and duration of this communication are controlled by the position, height and shape of aperture 66 relative to the position, height and shape of the upstream end of transfer passage 24. These two openings are arranged to allow communication between the crankcase and the cylinder via transfer passage 24 for a period equal to or less than the period for which the downstream end of passage 24 is in communication with the cylinder or the downstream end of the passage 24 has been uncovered by the piston. The transfer passage 24 is therefore closed at its upstream end for the majority of the time by the skirt or the piston 8 but as the piston approaches the bottom dead centre position shortly after the exhaust port 22 has been uncovered by the piston the aperture 66 comes into registry with the upstream end of the transfer passage 24 and the compressed air within the crankcase flows through the aperture 66 into the transfer passage 24 and thus into the cylinder 2. The use of the piston skirt as a non-return valve means at the upstream end of the transfer passage 24 permits the aperture 66 to be positioned such that airflow through the transfer passage 24 commences earlier, at the same time or later than that through the other two transfer passages.

Figure 3:
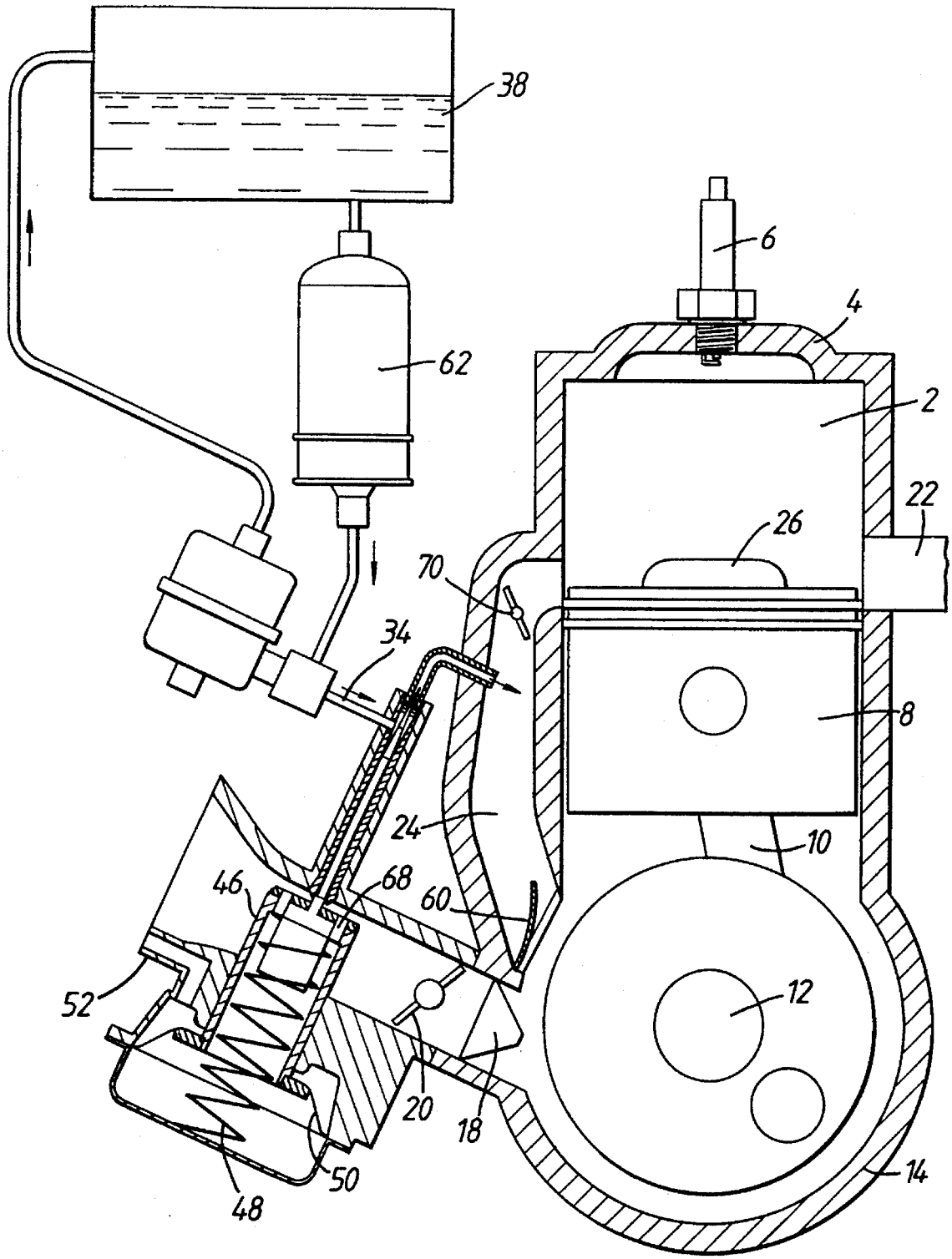
FIG. 3 is a similar view of a third embodiment of an engine similar to that shown in FIG. 2.

The embodiment of FIG. 3 is similar to that of FIG. 2, but differs from it in four respects. Firstly, the non-return valve means in this embodiment is again constituted by a Reed valve 60, as in the embodiment of FIG. 1. Secondly, the boost venturi 56 has been omitted and the operating sleeve 46 of the diaphragm actuator is positioned within the inlet duct 16. The pressure within the inlet duct 16 is communicated to one side of the diaphragm 50 through one or more holes 68 in the operating sleeve whilst the other side of the diaphragm is subjected to atmospheric pressure via a pipe 52, as before. Thirdly, the upper edges of all the transfer passages 24,26 are at the same level, whereby all the transfer passages are uncovered simultaneously during the working stroke of the piston. Fourthly, a throttle valve 70 is positioned in the transfer passage 24. This delays the flow of fuel and air through the passage 24 relative to the flow of pure air through the other transfer passages. The throttle valve 70 is connected to be moved by an actuator (not shown) in response to signals produced by the engine management system so that its position is optimised for all operating conditions of the engine. In other respects, the construction and operation of the embodiment of FIG. 3 is the same as that of FIG. 2.

Figure 4:
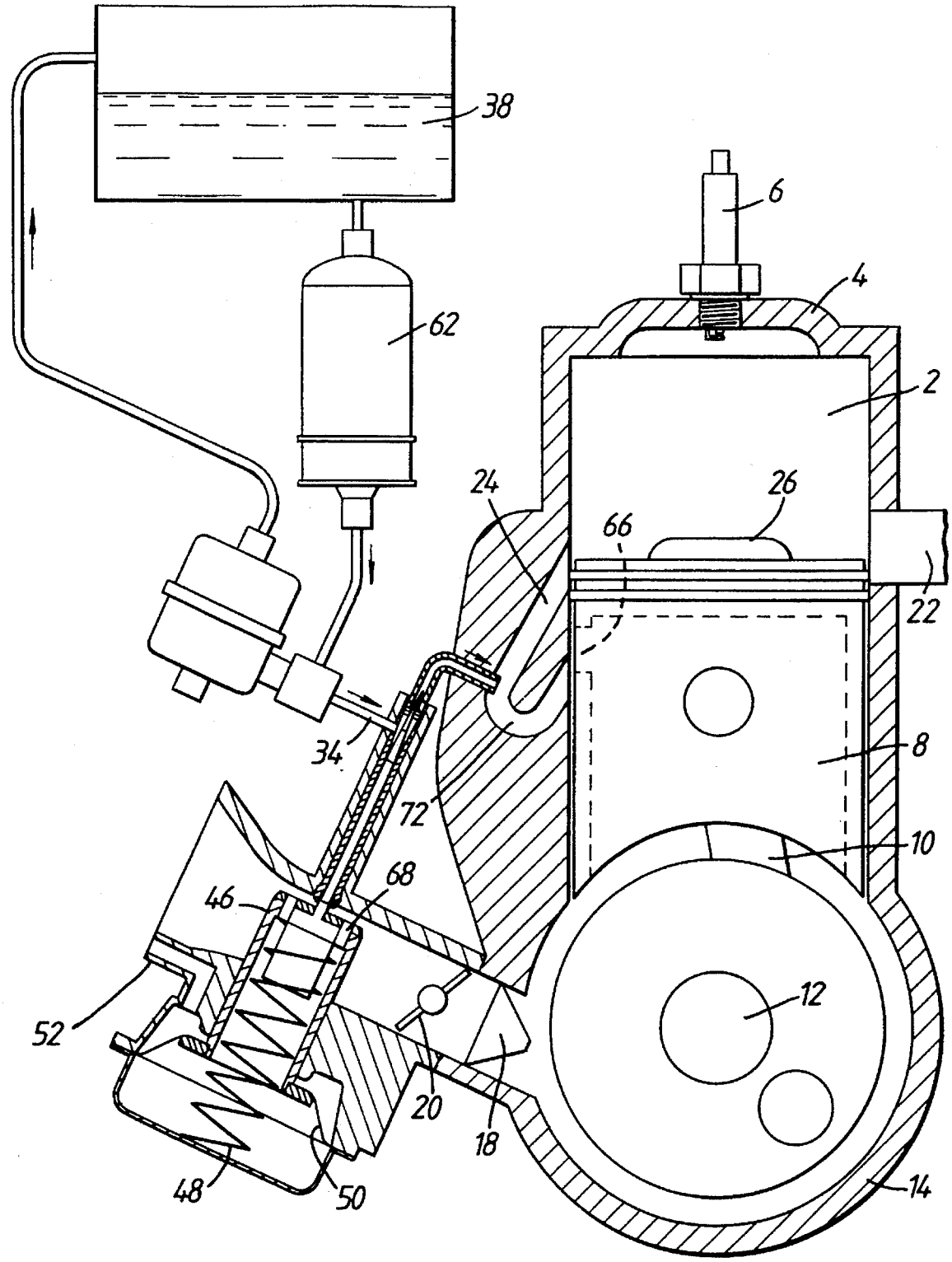
FIG. 4 is a similar view of a fourth embodiment in which the non-return means is constituted by a U bend liquid trap.

The embodiment shown in FIG. 4 is very similar to that of FIG. 3 and differs from it only in that the non-return valve 60 is replaced by a U bend liquid trap 72. This necessitates only a simple reshaping and reorientation of the transfer passage 24. The transfer passage 24 thus has a portion which is lower than both its ends and at those times when no air is flowing through the passage 24 from the crankcase the fuel supplied into the passage 24 simply accumulates in the U bend 72 and does not flow back into the crankcase. On the next occasion that air flows from the crankcase through the passage 24 the fuel accumulated in the U bend is entrained with it and carried into the cylinder. The U bend is of course of sufficient volume to accommodate all the fuel dispensed into the passage 24 between successive periods in which air flows through the passage 24. In this case the piston 8 is again provided with orifice 66 communicating with its interior, as in FIG. 2, but it will be appreciated that this is not necessary and that apart from the shape of the transfer passage 24 the constructional details of the engine may in fact be substantially the same as those shown in FIG. 1.

Obviously, numerous modifications and variations of the present invention are possible in the light of the above teachings. It is therefore to be understood that within the scope of the appended claims, the invention may be practiced otherwise than as specifically described herein.

I claim:

1. A two-stroke engine of crankcase scavenged type including a crankcase, a cylinder, a piston reciprocably mounted in said cylinder, an exhaust port communicating with said cylinder, an inlet port arranged to supply combustion air to said crankcase, a transfer port comprising at least two transfer passages extending between said crankcase and said cylinder, said transfer port being arranged to open before said exhaust port closes whereby, in use, said cylinder is scavenged, and fuel metering means which communicates with at least one but not all of said transfer passages and is arranged to supply fuel into said one transfer passage, said fuel metering means including a metering valve and actuating means connected to said metering valve, said actuating means being arranged to modulate said metering valve in response to the mass flow rate of air through said inlet port, and fuel supply means arranged to supply pressurised fuel substantially continuously to said metering valve, non-return means being provided in said transfer passage and arranged to prevent the flow of said fuel from said one transfer passage into said crankcase.

2. An engine as claimed in claim 1 wherein said one transfer passage communicates with said cylinder at a position which is closer to said crankcase than the position at which each of the remainder of said transfer passages communicate with said cylinder.

3. An engine as claimed in claim 1 wherein said one transfer passage includes a throttling device.

4. An engine as claimed in claim 1 wherein said fuel supply means comprises a float-controlled reservoir situated above said metering valve, whereby the fuel at said metering valve is pressurised by the hydrostatic head of fuel above it, the interior of said reservoir above the level of fuel within it communicating directly with said one transfer passage.

5. An engine as claimed in claim 4 wherein the outlet of said metering valve and the transfer passage end of the communication between said reservoir and said one transfer passage are directed in the same direction with respect to the direction of flow within said one transfer passage.

6. An engine as claimed in claim 4 wherein said metering valve comprises a valve orifice cooperating with a valve needle, said valve needle being connected to said actuating means.

7. An engine as claimed in claim 1 wherein said fuel supply means comprises a fuel pump and said metering valve is of the type known per se whose throughput is substantially independent of the pressure prevailing at its outlet.

8. An engine as claimed in claim 1 wherein said non-return means comprises a valve.

9. An engine as claimed in claim 1 wherein said non-return means comprises a portion of said piston which is so shaped that it obstructs the upstream end of said one transfer passage at substantially all times except that time during which fuel is to be admitted into said cylinder.

10. An engine as claimed in claim 8 wherein said non-return valve is connected to the engine crankshaft to be operated in synchronism therewith such that said non-return valve is closed at substantially all times except that time during which fuel is to be admitted into said cylinder.

11. An engine as claimed in claim 1 wherein said non-return means comprises a portion of said one transfer passage which is shaped in the manner of a U bend to act as a liquid trap.

12. An engine as claimed in claim 1 wherein said actuating means includes a movable diaphragm, one side of said diaphragm being subjected to the pressure within said inlet port.

13. An engine as claimed in claim 1 including a boost venturi within said inlet port and wherein said actuating means includes a movable diaphragm, one side of said diaphragm being subjected to the pressure within said boost venturi.

* * * * *